United States Patent [19]

Domnikov

[11] Patent Number: 4,891,106

[45] Date of Patent: Jan. 2, 1990

[54] METHOD OF FORMING NONMAGNETIC SILVER ELECTRODES ON QUARTZ GLASS

[75] Inventor: Larissa Domnikov, Los Angeles, Calif.

[73] Assignee: Hughes Aircraft Company, Los Angeles, Calif.

[21] Appl. No.: 86,344

[22] Filed: Aug. 18, 1987

[51] Int. Cl.[4] ..... C25D 5/54

[52] U.S. Cl. ..... 204/30; 204/35.1; 204/37.1; 204/38.4

[58] Field of Search ..... 204/30, 35.1, 38.4, 204/37.1; 428/672, 673

[56] References Cited

U.S. PATENT DOCUMENTS

| | | | |
|---|---|---|---|
| 3,978,272 | 8/1976 | Donley | 428/434 |
| 4,091,172 | 5/1978 | Miller | 428/630 |
| 4,254,546 | 3/1981 | Ullery, Jr. | 29/572 |

OTHER PUBLICATIONS

Metal Finishing Guidebook and Directory for 1978, Metals and Plastics Publications, Inc. Hackensack NJ, pp. 312–317, 428–430.

F. A. Lowenheim, Electroplating, McGraw-Hill Book Co, N.Y., 1978, pp. 160–162, 257–263 and pp. 416–425.

*Primary Examiner*—T. Tung
*Assistant Examiner*—William T. Leader
*Attorney, Agent, or Firm*—Steven M. Mitchell; Wanda Denson-Low

[57] ABSTRACT

Conductive, adherent, non-magnetic deposits are formed on quartz glass by first applying a thin gold layer to the glass, and then depositing silver over the gold. The gold is deposited directly onto a very clean quartz glass substrate from an organo-metallic compound, and then fired to produce a metallic gold layer no more than about 5 microinches thick. A silver layer is deposited over the gold by first laying down a thin strike layer at high voltage, and then electrodepositing a further silver layer under a controlled current density. During the deposition of the final silver layer, the current is preferably applied in a periodic reverse current-pulse manner. Prior to depositing the gold layer, the quartz glass may be cleaned by wiping with acetone and baking in a vacuum to remove further contamination.

10 Claims, 1 Drawing Sheet

METHOD OF FORMING NONMAGNETIC SILVER ELECTRODES ON QUARTZ GLASS

This invention was made with government support under contract no. N00014-83-C-2120, awarded by the Dept. of the Navy. The government has certain rights in this invention.

BACKGROUND OF THE INVENTION

This invention relates to formation of electrodes on nonconductive substrates, and, more particularly, to the preparation of nonmagnetic electrodes on quartz glass.

In certain types of apparatus, it is necessary to have a highly conductive metallic layer or electrode on a nonconductive substrate. The most challenging aspect of preparing such metallic coatings is achieving good adherence or sticking of the metal to the substrate. If adherence is not attained, the metal layer peels or flakes away from the substrate during use. The deposition of conductive layers on quartz glass is of sufficient commercial importance that a technique for preparing such structures has been developed. A conductive silver electrode can be vapor deposited or sputtered onto a glass substrate, after first depositing a thin layer of chromium to promote adherence between the metallic coating and the glass. The resulting electrode is of high quality and is strongly adherent, but is also magnetic.

It has long been known that the silver cannot be deposited directly onto the quartz glass, because the silver does not adhere to the quartz glass in the absence of the chromium "sticky metal" layer. In many applications, the requirement of the initial chromium layer poses no problem. However, chromium is a magnetic material, and its use in some applications is unacceptable. No nonmagnetic substitute for the chromium is known for use in this application. Consequently, there is no technique for depositing fully nonmagnetic, highly conductive electrodes onto quartz glass substrates.

Fully nonmagnetic electrodes are required in certain applications, such as a spaceborne hydrogen maser atomic clock. In such a clock, a quartz glass bottle containing atomic hydrogen is placed into a resonant microwave cavity, wherein the microwaves can excite the hydrogen atoms in the bottle to resonate the cavity. The bottle must have conductive electrodes on the outer surface of the bottle, and electrodes must be fully nonmagnetic to avoid adverse magnetic reactions with the microwave excitation that might cause frequency shifting of the maser radiation. The electrodes must be highly conductive, of either copper or silver. Additionally, the electrodes must be firmly and integrally affixed to the quartz bottle in order to achieve the thermal stability of the quartz, as the metal electrodes themselves have many times the thermal expansion coefficient or quartz. The known techniques for depositing these electrode materials onto the glass surface do not result in acceptable electrodes, either because the electrode is not sufficiently adherent to its substrate or because the deposition process results in a magnetic material in the deposited structure, such as the chromium undercoating described previously.

One alternative is to fix thin sheets of the electrode material to the quartz glass substrate by physical means. For example, copper sheets can be fixed to the quartz glass with an adhesive such as epoxy, with the result that there is no magnetic material in the electrode. This solution has been found unacceptable, because during prolonged usage the adhesive tends to harden and crack. The thermally cycling environment also causes degradation of the adhesive, with the result that the copper pulls free from the surface, and detunes the cavity. This failed electrode cannot be readily repaired when the clock apparatus is in an unmanned orbiting satellite. It is believed that all approaches for physically attaching a conductive layer suffer from essentially the same problems, and the lack of reliability of such an approach precludes its use in this application.

There therefore exists a need for a technique for preparing a highly conductive silver or copper electrode on a quartz glass substrate, without the presence of any magnetic material. Such a technique must be reproducible, and must produce high quality electrodes that are reliable in use over extended periods of time. The present invention fulfills this need, and further provides related advantages.

SUMMARY OF THE INVENTION

The present invention resides in a method for depositing a nonmagnetic silver electrode on glass, and particularly quartz glass, and the electrodes so prepared. There is not use of a magnetic material in depositing the electrode, and the resulting electrode is fully nonmagnetic. The electrode is of high internal and surface quality and exhibits excellent adherence. It does not cause energy losses of the microwave signal. The electrode adheres well during extended use in a thermally cycling environment. The electrode of the invention can be applied using well established. techniques, although care must be taken in using the techniques. The resulting electrode is unique, in that it has the high electrical conductivity of silver, but is fully nonmagnetic.

In accordance with the invention, a method for applying a nonmagnetic electrically conductive coating to a quartz glass surface comprises the steps of furnishing a clean quartz glass surface, depositing a layer of gold on the quartz glass surface, the layer having a thickness of less than about 5 microinches, and depositing a silver layer over the gold layer, thereby forming a coherent, nonmagnetic, electrically conductive coating on the quartz glass substrate.

The gold layer is preferably deposited by spraying onto the surface an organometallic compound containing gold. Such compounds are commercially available in a range of gold concentrations. The coating is then fired at elevated temperature to remove the organic component and consolidate the gold to a metallic structure. The gold coating is less than about 5 microinches (0.000005 inches) thick, as substantially thicker coatings result in a loss of microwave conductivity of the final structure, and specifically cause the Q value to decrease.

The silver is preferably applied by electrodeposition in two steps, from an aqueous solution of silver and cyanide ions. A silver strike layer is first deposited over the fired gold layer at a relatively high voltage for a short time, preferably 3.5 volts for 15 seconds. The silver strike layer serves as a base for further electrodeposition of the remainder of the silver layer under a controlled current density of less than 10, preferably about 7.5, amperes per square foot. The preferred procedure for the deposition of the silver from solution uses a periodic, repeating pulse pattern consisting of 6 current pulses in 8 time intervals, in which current flows 75 percent of the time and the current is "off" 25 percent of the time. In 4 of each 6 "on" pulses the current is applied in the forward or deposition direction, and in 2 of each 6 pulses the current is applied in the reverse or dissolution direction. The cyclic repetitions of the pulse pattern preferably occur at a rate of 480 Hertz. Under these preferred conditions, about 0.002 inches of silver is deposited in 2 hours.

A key consideration in the process of the invention is ensuring cleanliness of the surfaces upon which deposited is to occur. The initial quartz glass surface is repeatedly cleaned by wiping with a volatile organic solvent that does not leave a residue. Acetone is preferred. After the gold coating is fired, it is first cleaned in a hot alkaline cleaner and then in hydrochloric acid, and is finally rinsed in deionized water before the deposition of the silver strike layer. A surface to be deposited upon is not touched with the hands or other foreign objects.

Various approaches to masking the regions adjacent those to be covered by the deposited electrode were studied. Those masks using organic or volatile components tended to contaminate the surface being masked. Accordingly, the preferred mask is a metallic cup, preferably aluminum, applied over the area to be masked to prevent deposition thereupon. This approach was successful in preventing deposition on the masked areas at the ends of the electrodes. It was also necessary to provide gaps between the sectors of the electrodes, and these gaps were formed by burning away material with a neodymium-YAG laser, resulting in a smooth electrode edge and acceptable performance.

In a preferred embodiment of the invention, a method for applying a nonmagnetic electrically conductive coating to a quartz glass surface comprises the steps of: cleaning a quartz glass surface with an organic solvent, baking the quartz glass surface in vacuum to remove further contamination, applying a liquid organometallic compound containing gold to the cleaned quartz glass surface, firing the quartz glass surface to remove the organic and consolidate a gold coating on the surface, the amount of gold applied in the step of applying being such that the fired gold coating has a thickness of less than about 5 microinches, electrodepositing a silver strike layer overlying the fired gold coating at an applied voltage of at least about 3.5 volts, and electrodepositing a silver layer over the silver strike layer under conditions of alternating forward and reverse electrodeposition current, thereby forming a coherent, nonmagnetic, highly electrically conductive coating on the quartz glass surface.

In a most preferred embodiment, a method for applying a nonmagnetic electrically conductive coating to a quartz glass surface, comprises the steps of cleaning a quartz glass surface with acetone, baking the quartz glass surface in a vacuum of about $10^{-7}$ Torr at about 500° C. for about 1 hour, to remove further contamination, applying an organometallic compound containing gold to the cleaned quartz glass surface, firing the quartz glass surface at a temperature of from about 800° C. to about 1000° C. for about 30 minutes, after heating the glass surface to the firing temperature over a period of about 2 hours, the amount of gold applied in said step of applying being such that the fired gold coating has a thickness of less than about 5 microinches, cleaning the fired surface in an alkaline cleaner, dipping the cleaned surface into hydrochloric acid solution and rinsing the surface in water, electrodepositing a layer of silver strike overlying the fired gold coating at an applied voltage of at least about 3.5 volts, and electrodepositing a layer of silver over the silver strike layer from an aqueous solution containing silver and cyanide ions using a periodic, repeating pulse pattern consisting of 6 current pulses in 8 time intervals, in which in 4 of each 6 pulses the current is applied in the forward direction, and in 2 of each 6 pulses the current is applied in the reverse direction, the cyclic repetitions of the pulse pattern occurring at a rate of 480 Hertz, thereby forming a coherent, nonmagnetic, electrically conductive coating on the quartz glass surface.

The resulting electrodes were extensively tested, and it was determined that they have excellent conductivity and surface structure. They are adherent initially and after use, including thermal cycling of the quartz glass and electrode to simulate thermal cycles of a spacecraft. No other technique is known for attaining an electrode of this quality on quartz glass, which is entirely nonmagnetic.

The approach of the invention provides an important advance in the art of electrode coatings on quartz glass. The electrodes of the invention are high conductivity silver electrodes that are completely adherent. At the same time, the electrodes are fully nonmagnetic, and do not interfere with maser emission in the bottle upon which they are deposited. Other features and advantages of the invention will be apparent from the following detailed description of the preferred embodiment, taken in conjunction with the accompanying drawings, which illustrate, by way of example, the principles of the invention.

DETAILED DESCRIPTION OF THE PREFERRED EMBODIMENT

Figure 1:
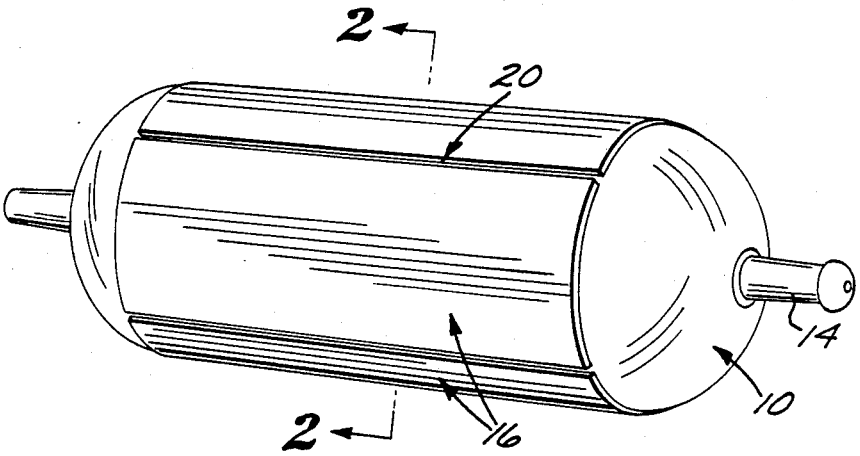
FIG. 1 is a perspective drawing of a quartz bottle having silver electrodes thereupon.
Figure 2:
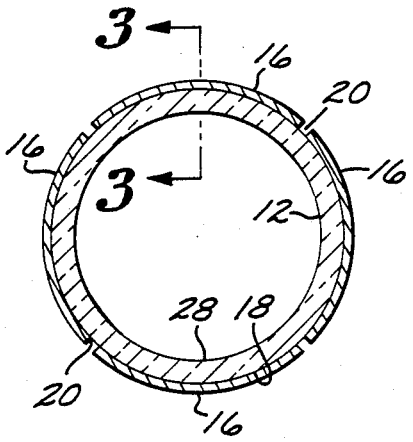
FIG. 2 is a sectional view of the bottle along lines 2—2.

The process of the present invention, for depositing silver electrodes, is preferably used for depositing electrodes on a quartz glass bottle 10 used in a hydrogen maser clock system. As illustrated in FIG. 1, the quartz glass bottle 10 is an elongated quartz glass envelope that is closed at each end and has a generally cylindrical quartz wall 12. A tube 14 penetrates the closure at each end to permit introduction of hydrogen gas to the interior of the bottle 10. Four silver electrodes 16 are deposited on the outside surface 18 of the wall 14. The electrodes 16 run most of the length of the bottle 10, and around most of its circumference. There is a circumferential gap 20 between each of the electrodes 16, so that each electrode constitutes an electrode segment that extends just under 90 degrees around the circumference. The present invention is concerned with the formation of the electrodes 16 on the surface 18 of the quartz wall 12.

The bottle 10 is formed of a standard industrial grade of quartz glass. (As used herein, quartz glass is a species of glass.) The bottle 10 is provided in essentially its final shape and configuration. However, the present process does not preclude other steps after the electrodes 16 are deposited, such as thinning of the wall 12 from the inside and the deposition of special coatings on the inside of the wall 12.

The quartz glass bottle was first cleaned by multiple wipings with acetone. It was then baked in vacuum at elevated temperature to removed other surface contaminants and residues. An acceptable baking is at a temperature of 500° C. and a vacuum of $10^{-7}$ Torr for 1 hour. The bottle 10 was then slowly cooled to ambient temperature and then immediately (within 3 minutes) coated in the next step.

The end portions of the bottle 10 that were not to be covered with an electrode 16 were masked with aluminum cups to prevent deposition on unintended end portions of the bottle 10. The unmasked portion waas then coated by spraying with a thin layer of an organometallic compound containing gold. An example is tolyldichlorogold. The preferred gold-containing liquid paint has about 20 percent gold, and is sold by Englehard, Inc. as NW gold paint, but other mixtures have been successfully used. The gold-containing compound was sprayed onto the surface 18 using a Paasche air brush operated at a pressure of 25 pounds per square inch, in a clean room to minimize the chance of contamination of the gold by air-borne particles. Prior to spraying, the commercial gold paint was diluted with 25 percent by volume of xylene, so that it would flow and spray smoothly. Three passes in the same direction provided a sufficient amount of the mixture onto the surface, although this amount can be readily determined from a few trials if necessary. In particular, it was found that the thickness of the gold coating, after firing, should not exceed 5 microinches (5 one-millionths of an inch), and the amount sprayed onto the surface was adjusted to achieve this amount. Preferably, the thickness of the final fired gold layer is about 2–3 microinches.

The sprayed gold coating was fired at 800° C. in air for 30 minutes. The firing temperature was reached by gradually heating the bottle over a period of 2 hours, and after firing the bottle was cooled to ambient temperature overnight. The resulting gold layer 22 was uniform and of a thickness of about 2–3 microinches.

In preparation for the deposition of silver over the gold, the gold-coated bottle 10 was cleaned thoroughly to remove contaminants from the surface of the gold. The bottle was cleaned in a commercial alkaline cleaner, Oakite 80, available from Oakite Products, at a temperature of 160° F. for 30 seconds, and rinsed with dionized water. The bottle was then cleaned in a 50 percent hydrochloric acid solution for 10 seconds at ambient temperature, and rinsed with deionized water.

Figure 3:
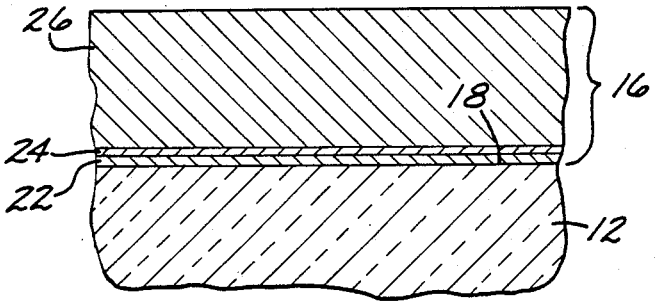
FIG. 3 is an enlargement of a detail of FIG. 3, illustrating the structure of the electrode and the layers therein.

The silver electrode 16 was electrodeposited from a silver containing bath. Referring to FIG. 3, a silver strike layer 24 was first deposited on top of the gold layer 22, from a solution containing 0.3 troy ounces per gallon of silver metal and 8 ounces per gallon of free cyanide ion. A steady direct voltage of 3.5 volts, applied for 15 seconds at ambient temperature, accomplished the deposition of the silver strike layer 24. The thickness of the strike layer 24 cannot be measured directly, but is believed to be about 10 microinches (10 millionths of an inch) thick.

A silver layer 26 was then deposited over the silver strike layer 24, from a solution containing about 7 troy ounces per gallon of silver metal and about 8 ounces per gallon of free cyanide ion. The deposition was accomplished with a pulsed periodic current with an applied current density of 7.5 amperes per square foot. Each cycle of current application was divided into 8 time intervals. During four of the intervals, the current was applied in the forward or deposition direction. During two of the intervals, the current was applied in the reverse or dissolution direction. During the remaining two intervals, the current was applied in the reverse or dissolution direction. During the remaining two intervals, no current was applied. The alternating arrangement of pulses has the following sequence: reverse, forward, reverse, forward, off, forward, off, forward. This string of 8 time intervals and the pulses therein, termed a sweep, was repeated at the rate of 480 Hertz (cycles per second). Under these conditions, the silver layer 26 about 0.0015 to 0.002 inches thick was deposited in two hours. The silver layer 26 was later studied by scanning electron microscopy and determined to be of excellent integrity and smoothness. The silver had a smooth, semi-bright appearance, and was adherent to the quartz glass substrate.

For the purposes of clarity of presentation in the discussion, the silver strike layer 24 and the silver layer 26 have been given separate reference numerals in the drawings. However, the two layers 24 and 26 are physically continuous, and no separation or physical interface between them can be seen or detected. It is believed that the initial deposition of the silver at higher voltage levels aids in preparing the gold surface for deposition of the remainder of the silver in the layer 26.

As indicated, the end portions that were not to be covered by the electrodes 16 were masked with aluminum covers to prevent deposition thereon. After deposition of the layer 26 was complete, the aluminum masking cups were removed. The gaps 20 were formed with a Nd-YAG laser operating at 1.06 micrometers, and a power input of 4 millijoules. The edges of the completed electrodes were smooth.

For reasons related to the proper functioning of the maser, after completion of the fabrication of the electrodes 16 the inside surface 28 of the wall 12 was coated with teflon. The teflon was applied in layers and cured, without adverse effect on the electrodes 16.

Measurements of the coupling parameter Q were conducted, to verify the operability of the process. The Q value, a conventionally determined reciprocal quantity, is responsive to, and therefore measures, the dissipation of power due to defects in the electrodes or present because of the bonding of the electrodes to the surface of the bottle 12, among other factors. In tests of 6 specimens (test tubes and bottles) having electrodes prepared by the present method, Q values of 8959, 7955, 7220, 6839, 6660, and 5257 were obtained. It is judged that bottles with electrodes having Q values greater than about 6000 are acceptable for use in a maser atomic clock, and 5 of the 6 samples fabricated with the present invention met this criterion. It is therefore possible to check completed electrodes before placing the bottles 12 into service, to verify the quality obtained. Had the electrode been magnetic or contained magnetic materials, acceptable Q values could not have been obtained.

It will be appreciated that the process of the invention results in a high quality, high conductivity silver electrode on a quartz glass bottle. Significantly, the electrode is nonmagnetic, and can be used in a microwave cavity without frequency loss of the hydrogen in the hydrogen-containment bottle of a hydrogen atomic maser clock. Although a particular embodiment of the invention has been described in detail for purposes of illustration, various modifications may be made without departing form the spirit and scope of the invention.

Accordingly, the invention is not to be limited except as by the appended claims.

What is claimed is:

1. A method for applying a nonmagnetic electrically conductive coating to a quartz glass surface, comprising the steps of:

furnishing a clean quartz glass surface;

depositing a layer consisting of gold on the quartz glass surface, the layer having a thickness of less than about 5 microinches, the step of depositing including the substeps of applying to the quartz glass surface on organometallic compound containing gold, and firing the quartz glass surface and applied compound to form a coherent gold coating;

electrodepositing a silver layer over the gold layer, thereby forming a coherent, nonmagnetic, electrically conductive coating on the quartz glass surface.

2. The method of claim 1, wherein said step of depositing a silver layer includes the substeps of:

depositing a silver strike layer over the layer of gold; and depositing a layer of electrodeposited silver over the silver strike layer.

3. The method of claim 2, wherein said substep of depositing a layer of electrodeposited silver includes the substeps of:

furnishing a silver cyanide solution, and electrodepositing silver from the silver cyanide solution under conditions of forward current interspersed with reversed current.

4. The method of claim 1, including the further step of removing a portion of the conductive coating with a laser.

5. A method for applying a nonmagnetic electrically conductive coating to a quartz glass surface, comprising the steps of:

cleaning a quartz glass surface with an organic solvent;

baking the quartz glass surface in vacuum to remove further contamination;

applying a liquid organometallic compound containing gold to the cleaned quartz glass surface;

firing the quartz glass surface to remove the organic and consolidate a gold coating on the surface, the amount of gold applied in said step of applying being such that the fired gold coating has a thickness of less than about 5 microinches;

electrodepositing a silver strike layer overlying the fired gold coating at an applied voltage of at least about 3.5 volts; and electrodepositing a silver layer over the silver strike layer under conditions of alternating forward and reverse electrodeposition current, thereby forming a coherent, nonmaganetic, electrically conductive coating on the quartz glass surface.

6. The process of claim 5, wherein said step of electrodepositing a silver layer over the silver strike layer includes the substeps of:

furnishing an aqueous solution comprising silver and cyanide ions.

placing the quartz glass surface into the solution, and applying a plating to the surface using a current density of less than about 10 amperes per square foot, under a duty cycle wherein the current is applied in a forward direction for a portion of the time and in a reverse direction for a portion of the time.

7. The method of claim 5, including the further step of removing a portion of the deposited layer with a laser.

8. A method for applying a nonmagnetic electrically conductive coating to a quartz glass surface, comprising the steps of:

cleaning a quartz glass surface with acetone;

baking the quartz glass surface in a vacuum of about $10^{-7}$ Torr at about 500° C. for about 1 hour, to remove further contamination;

applying an organometallic compound containing gold to the cleaned quartz glass surface;

firing the quartz glass surface at a temperature of from about 800° C. to about 1000° C. for about 30 minutes, after heating the quartz glass surface to the firing temperatures over a period of about 2 hours, the amount of gold applied in said step of applying being such that the fired gold coating has a thickness of less than about 5 microinches;

cleaning the fired surface in an alkaline cleaner;

dipping the cleaned surface into hydrochloric acid solution and rinsing the surface in water;

electrodepositing a layer of silver strike overlying the fired gold coating at an applied voltage of at least about 3.5 volts; and electrodepositing a layer of silver over the silver strike layer from an aqueous solution containing silver and cyanide ions using a periodic, repeating pulse pattern consisting of 6 current pulses in 8 times intervals, in which in 4 of each 6 pulses the current is applied in the forward direction, and in 2 of each 6 pulses the current is applied in the reverse direction, the cyclic repetitions of the pulse pattern occurring at a rate of 480 Hertz, thereby forming a coherent, nonmagnetic, electrically conductive coating on the quartz glass surface.

9. The method of claim 8, including the further step of removing a portion of the conductive coating with a laser.

10. A method for applying a nonmagnetic electrically conductive coating to a quartz glass surface, consisting of:

furnishing a clean quartz glass surface;

depositing a layer containing gold on the quartz glass surface, the layer having a thickness of less than about 5 microinches, the step of depositing including the substeps of applying to the quartz glass surface on organometallic compound containing gold, and firing the quartz glass surface and applied compound to form a coherent gold coating;

electrodepositing a silver layer over the gold layer, thereby forming a coherent, nonmagnetic, electrically conductive coating on the quartz glass surface.

* * * * *

UNITED STATES PATENT AND TRADEMARK OFFICE

CERTIFICATE OF CORRECTION

PATENT NO. : 4,891,106

DATED : January 2, 1990

INVENTOR(S) : Larissa Domnikov

It is certified that error appears in the above-identified patent and that said Letters Patent is hereby corrected as shown below:

Claim 1, col. 7, line 12, delete "on" and insert instead --an--.

Claim 5, col. 7, line 57, delete "nonmaganetic" and insert instead --nonmagnetic--.

Claim 6, col. 7, line 63, delete "ions." and insert instead --ions,--.

Claim 8, col. 8, line 36, delete "times" and insert instead --time--.

Signed and Sealed this

Nineteenth Day of February, 1991

*Attest:*

HARRY F. MANBECK, JR.

*Attesting Officer*

*Commissioner of Patents and Trademarks*